US005403138A

United States Patent [19]

Otake et al.

[11] Patent Number: 5,403,138

[45] Date of Patent: Apr. 4, 1995

[54] BOOKLET ALBUM INCLUDING A DOUBLE-SIDED PHOTOGRAPH AND A METHOD OF MAKING THE SAME

[75] Inventors: Katsumi Otake; Zenya Tanabe; Yoshihiro Tsukiji, all of Tokyo; Toru Kurokawa, Kanagawa; Takakazu Akiyama, Tokyo, all of Japan

[73] Assignee: Fuji Photo Film Co., Ltd., Kanagawa, Japan

[21] Appl. No.: 959,133

[22] Filed: Oct. 9, 1992

[30] Foreign Application Priority Data

| | | | |
|---|---|---|---|
| Oct. 9, 1991 | [JP] | Japan | 3-290984 |
| Nov. 1, 1991 | [JP] | Japan | 3-287705 |
| Nov. 1, 1991 | [JP] | Japan | 3-287707 |
| Mar. 12, 1992 | [JP] | Japan | 4-053900 |

[51] Int. Cl.[6] ..... B42C 9/00

[52] U.S. Cl. ..... 412/1; 412/8; 281/22; 281/21.1

[58] Field of Search ..... 283/81; 40/156; 412/33, 412/1, 8; 281/21.1, 22

[56] References Cited

U.S. PATENT DOCUMENTS

| | | | |
|---|---|---|---|
| 5,026,236 | 6/1991 | Otake et al. | 412/33 |
| 5,038,503 | 8/1991 | Goldberg | 40/156 |
| 5,203,590 | 4/1993 | Ronson | 281/21.1 |
| 5,229,190 | 7/1993 | Clement et al. | 428/195 |

*Primary Examiner*—Willmon Fridie

*Attorney, Agent, or Firm*—Sughrue, Mion, Zinn, Macpeak & Seas

[57] ABSTRACT

A booklet album including a stack of several double-sided photographs and covered with a protective cover. The booklet album includes pages which are designated to bear selected original frames from a photographic film strip of a predetermined size. The photoprints are stacked in the order designated for each page. Each double-sided photograph, includes two photoprints, which are laminated with one transparent sheet on their front surface. The laminated sheets are folded between the photoprints. A customer may order such a booklet album by making desired selections on an order form. Stickers are provided on the form, and placed on desired frames of a film strip. The stickers have markings so as to indicate which page the desired printed frames are to be positioned as well as markings indicating the size and orientation of the printed frame.

24 Claims, 17 Drawing Sheets

| PAGE | 1 | 2 | 3 | 4 | 5 | 6 | 7 | 8 | 9 | 10 | 11 | 12 |
|---|---|---|---|---|---|---|---|---|---|---|---|---|
| RANGE TO BE PRINTED | A | A | B | A | A | B | B | A | A | A | B | C |

FIG. 13
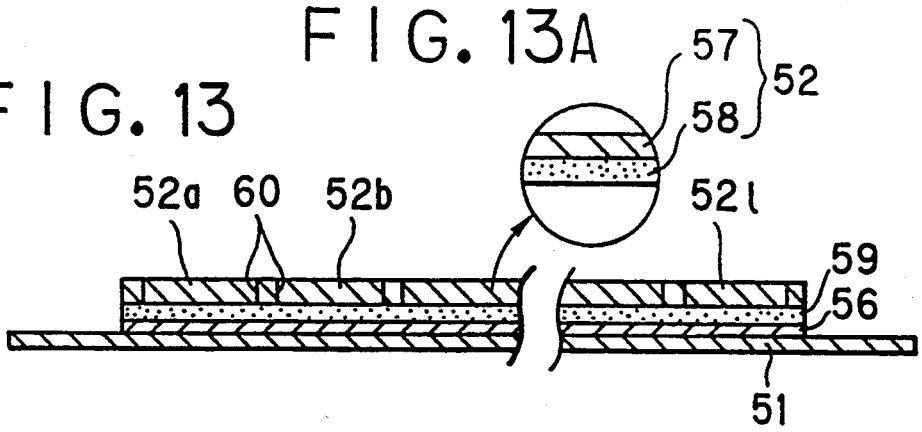
FIG. 13A
FIG. 14A
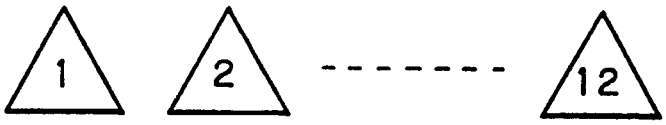
FIG. 14B
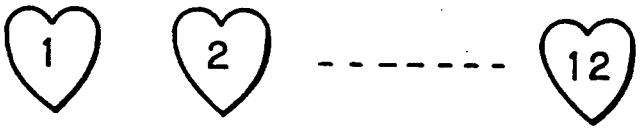
FIG. 14C
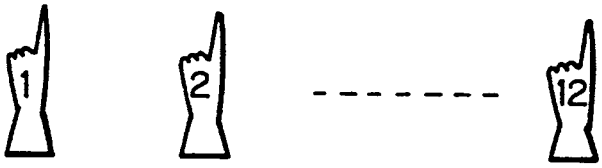
FIG. 16
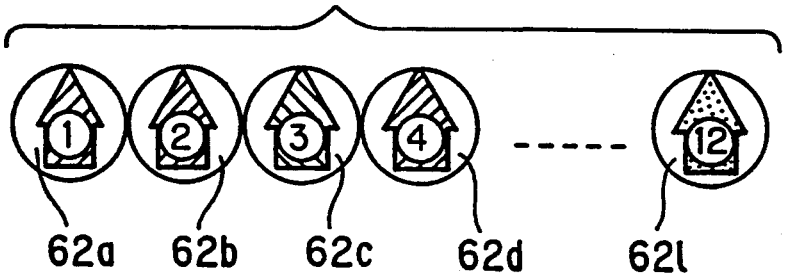

BOOKLET ALBUM INCLUDING A DOUBLE-SIDED PHOTOGRAPH AND A METHOD OF MAKING THE SAME

BACKGROUND OF THE INVENTION

1. Field of the Invention

The present invention relates to a booklet album and method of making the same and, more particularly, to an album including a stack of double-sided photographs bound together and a method of making the same. The invention is also directed to an order form for ordering such an album.

2. Related Art

A booklet album (hereinafter referred to as an album) in which photographs are bound has been known e.g., from U.S. Pat. No. 5,026,236. The album including a cover helps preserve a great number of printed photographs (hereinafter referred to as photoprints). The cover includes a pair of front and rear faces and a back portion or spine. The rear surface of the back portion of the cover is provided with an adhesive layer. A plurality of photoprints are stacked, and attached to the adhesive layer. The cover is bent twice to sandwich the stack of the photoprints.

In a photo laboratory, a photofinisher receives a customer order for such an album. The photofinisher develops photographic film and produces photoprints. The developed prints are then bound into the album, which is then supplied to the customer. Such photoprints usually have an L-size (127×89 mm), which is well known in the field of photography.

There is, however, a problem in such conventional albums in that the printed surfaces of the photoprints are susceptible to dust, fingerprints, etc. Moreover, because photoprints are bound as leaves within the album, the prints are not preserved over a long duration.

The conventional album is also disadvantageous because it gives monotonous and boring impression. That is, it is not aesthetically pleasing to the eye. The conventional album is also disadvantageous because the prints are limited to one size throughout the complete album.

SUMMARY OF THE INVENTION

In view of the foregoing problems, an object of the present invention is to provide a booklet album of photoprints in which the photoprints can be preserved over a long period of time, a method of making such an album, which includes a double-sided photograph, and an order form for ordering such an album.

Another object of the present invention is to provide a method of making a booklet album which has an attractive and interesting impression.

A further object of the present invention is to provide a double-sided photograph convenient to be handled.

Still another object of the present invention is to provide a booklet album in which printed surfaces of photoprints are prevented from being contaminated with dirt or other foreign particles and/or excess adhesive agent.

In order to achieve the above and other objects, the present invention provides a method of making a booklet album having a plurality of photoprints bound to one another, including the steps of designating pages in the album for bearing selected original frames from a photographic film, designating layouts of the selected original frames to be reproduced within the designated pages, printing the selected original frames in accordance with the designated printing layouts in order to obtain the photoprints, arranging the photoprints on the pages in an order corresponding to the first and second designating steps, and combining the pages with the photoprints to form the album.

Further in accordance with the above objects, the present invention provides an order form for ordering a booklet album which includes a plurality of photoprints, the photoprints correspond to selected original frames of a film strip. The order form includes blanks for filling in information associated with the album, and page indicating stickers having an adhesive that are peelably mounted. The stickers are placed on the original frames of at least one film strip for designating where to position the photoprints within the album.

Still further, the present invention provides a double-sided photograph including a plurality of photoprints, and a single transparent sheet laminated on printed surfaces of the photoprints, the transparent sheet being folded between adjacent ones of the photoprints.

Even further, the invention provides a booklet album including a plurality of double-sided photographs stacked adjacent to one another, the double-sided photographs include at least two photoprints arranged side-by-side, the photoprints having a printed surface thereof laminated with a transparent sheet, and a first adhesive applied to rear surfaces thereof, the laminated photoprints being folded in half so that the rear surfaces are attached together through due to the first adhesive, and a cover for covering an outside of the stacked double-sided photographs.

BRIEF DESCRIPTION OF THE DRAWINGS

The above and other objects and advantages of the present invention will become more apparent from the following detailed description when read in connection with the accompanying drawings, in which:

FIG. 13 is a vertical section view of a sticker portion of the order form of FIG. 12, and FIG. 13A is an expanded portion of FIG. 13;

FIGS. 14A, 14B and 14C illustrate other exemplary sets of stickers;

FIG. 16 is an explanatory view illustrating another preferred set of stickers;

DETAILED DESCRIPTION OF PREFERRED EMBODIMENTS

Figure 1:
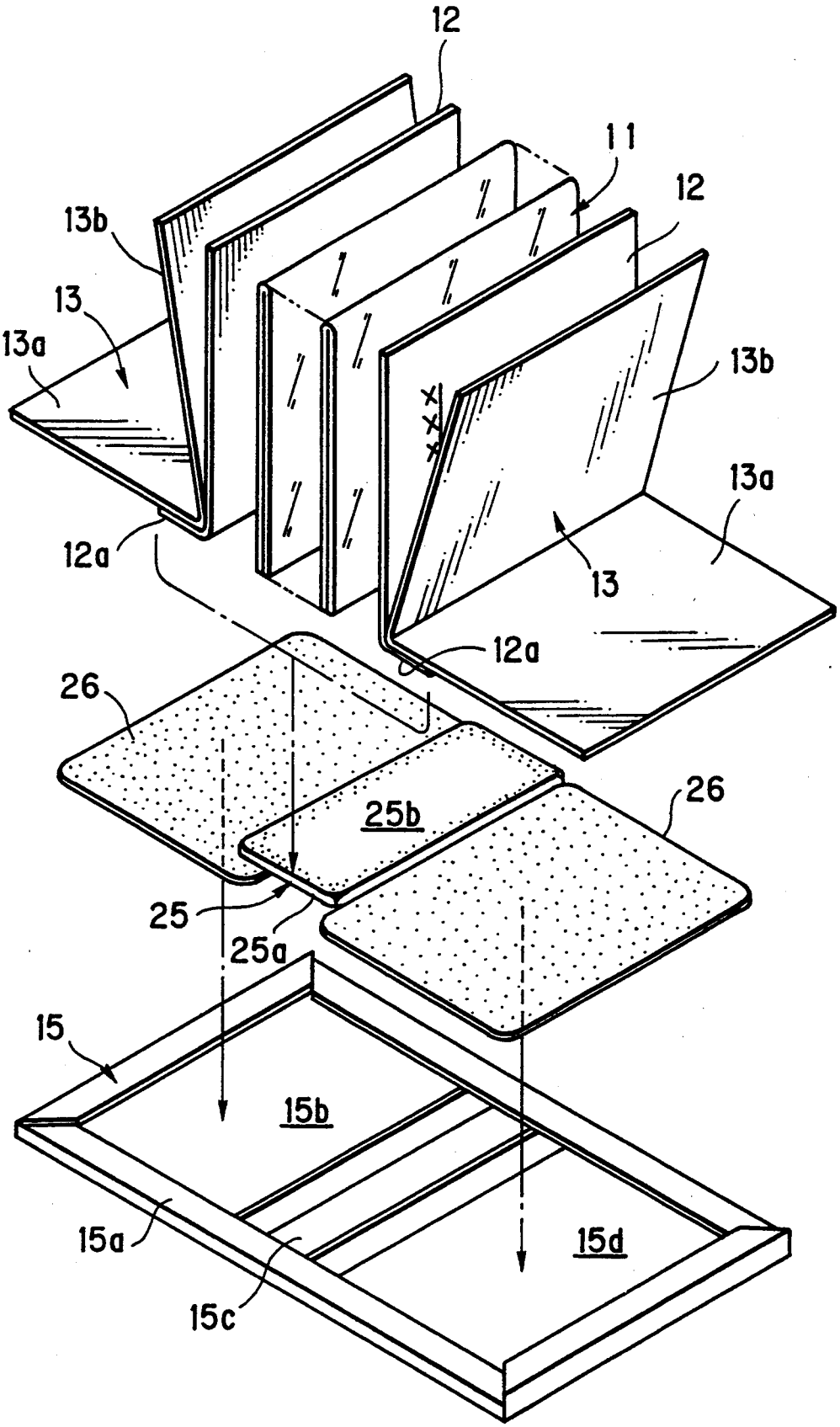
FIG. 1 is an exploded perspective view illustrating a booklet album according to the present invention.
Figure 2:
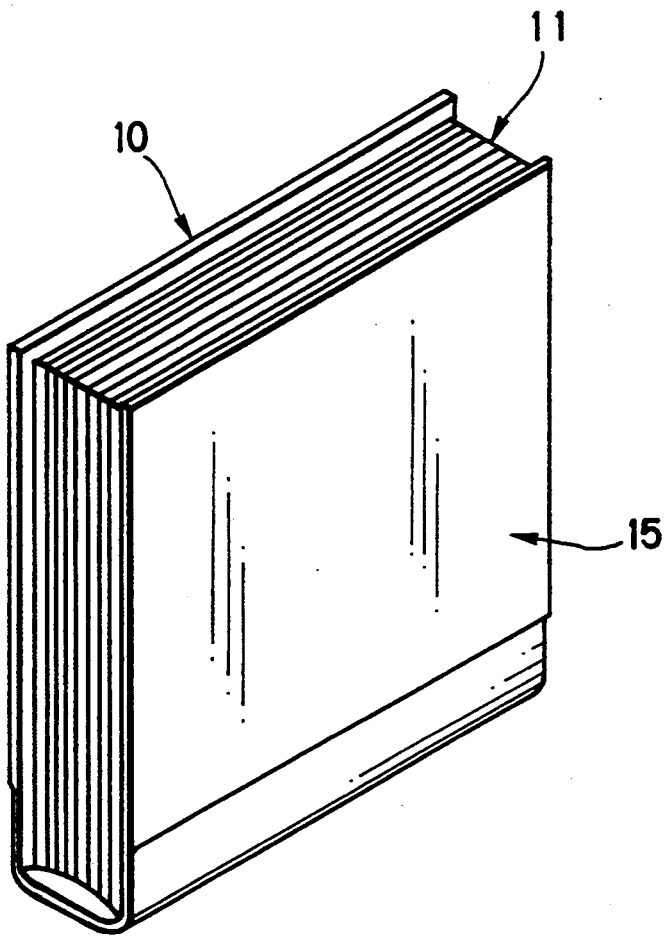
FIG. 2 is a perspective view illustrating the booklet album of FIG. 1 when bound and closed.

FIGS. 1 and 2 illustrate a novel booklet album 10, including a plurality of double-sided photographs 11 (or photo leaves) sandwiched between fly papers 12 and end papers 13, and bound between a solid cover 15.

Figure 3:
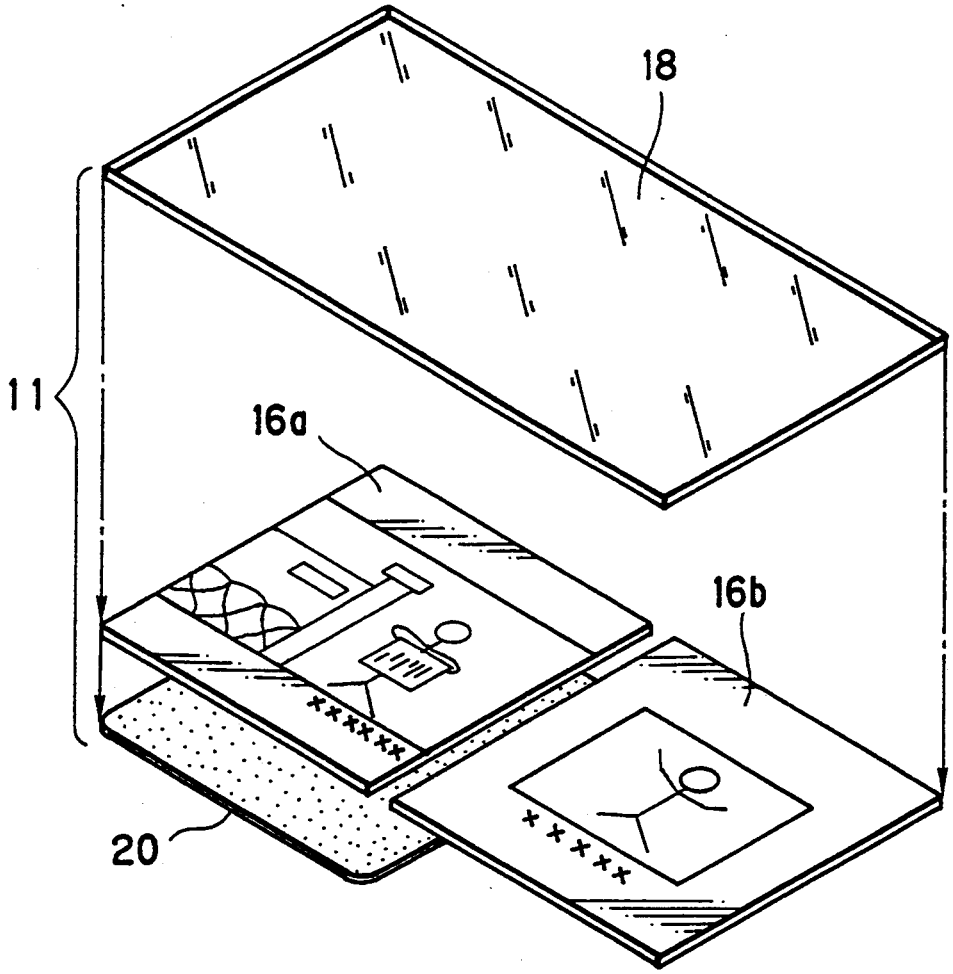
FIG. 3 is an exploded perspective view illustrating a manner of assembling a double-sided photograph used in the album of FIGS. 1 and 2.
Figure 4:
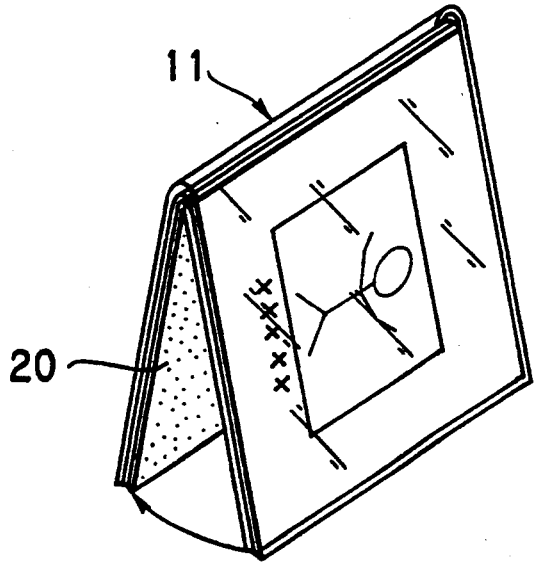
FIG. 4 is a perspective view illustrating the double-sided photograph.
Figure 5:
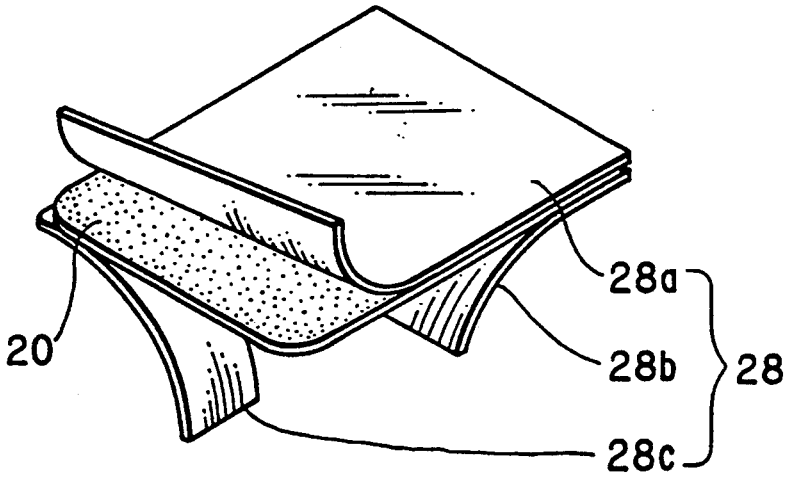
FIG. 5 is a perspective view illustrating a piece of adhesive tape.

Each side of the double-sided photographs 11 bear a photoprint 16*a* and 16*b* as shown in FIG. 3. The rear surfaces of the photoprints 16*a* and 16*b* are attached together so that each of the photoprints 16*a* and 16*b* faces the opposite direction. As shown in FIG. 5, double-sided adhesive tape 20, for example, is cut to a size corresponding to the photoprints 16*a* and 16*b* and applied to the rear surfaces of the prints 16*a* and 16*b*. The tape includes a peelable layer (e.g., paper) 28*a* to 28*c*, which avoids unnecessary adhesion of the tape 20 and which also makes it convenient for manually handling of the tape 20 when attaching it to the rear surfaces. Alternatively, the photoprints 16*a* and 16*b* may be attached together with an adhesive agent or hot-melt adhesive agent, instead of the tape 20.

Figure 6:
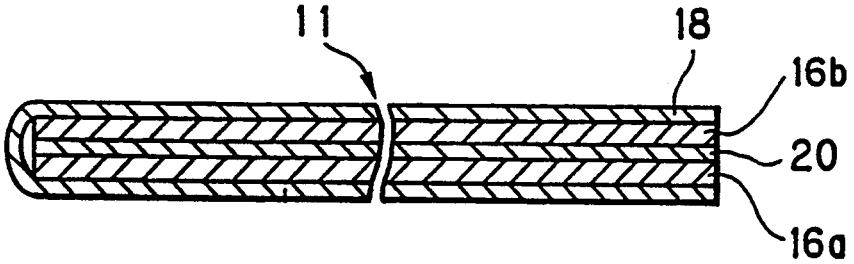
FIG. 6 is a cross-sectional view of the double-sided photograph.
Figure 6A:
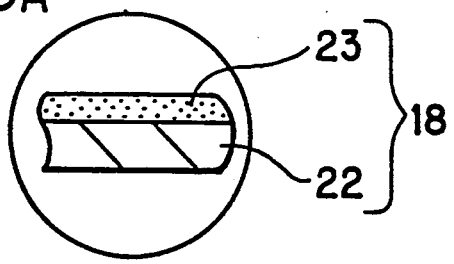
FIG. 6A is an expanded portion of FIG. 6.

The front surfaces of the photoprints 16*a* and 16*b* are protected by a transparent laminate sheet 18. The laminate sheet 18, as illustrated in FIG. 6, is constituted of a plastic film 22 and an adhesive layer 23, such as an hot-melt adhesive agent type. The printed surface of the photoprints 16*a* and 16*b* is covered by the laminate sheet 18 and attached thereto through the adhesive layer 23. The plastic film 22 is, for example, polypropylene (PP) film, or polyester (PET) film, and preferably has a characteristic of intercepting ultraviolet rays.

The fly papers 12 have back portions 12*a* bent toward the end papers 13, and attached to the back (or spine) of the end papers 13 by means of a paste or the like. When a plurality of double-sided photographs 11 are stacked and sandwiched between the end papers 13, the back of the stack of double-sided photos 11 is attached to a binding tape 25, which is constituted of a support 25*a* and an adhesive layer 25*b*. The layer 25*b* includes an adhesive agent mixture with of rubber, resin, and/or elastomer, as an example. The binding tape 25 is as long as the back of the stacked double-sided photos 11, and as wide so that longitudinal edges are bent and attached to each of the end papers 13.

The end papers 13 are folded in half providing an end leaf 13*a* and an extra fly leaf 13*b*. The backside of the end leaf 13*a* is attached to the cover 15 by double-sided adhesive tape 26, paste, or an adhesive agent.

The cover includes a cloth 15 and pieces of cardboard 15*b*, 15*c*, and 15*d* glued to the rear of the cloth, as shown in FIG. 1. A periphery 15*a* of the cover 15 is folded rearward and attached on peripheral portions of the cardboard 15*b*, 15*c* and 15*d*. The cloth 15 may alternatively be replaced other suitable material for bookbinding such as leather. The rear of the cardboard 15*b*, 15*c*, and 15*d*, together with the folded periphery 15*a*, are attached to the end papers 13.

Next, a procedure of binding an album as described above will be explained.

Figure 7:
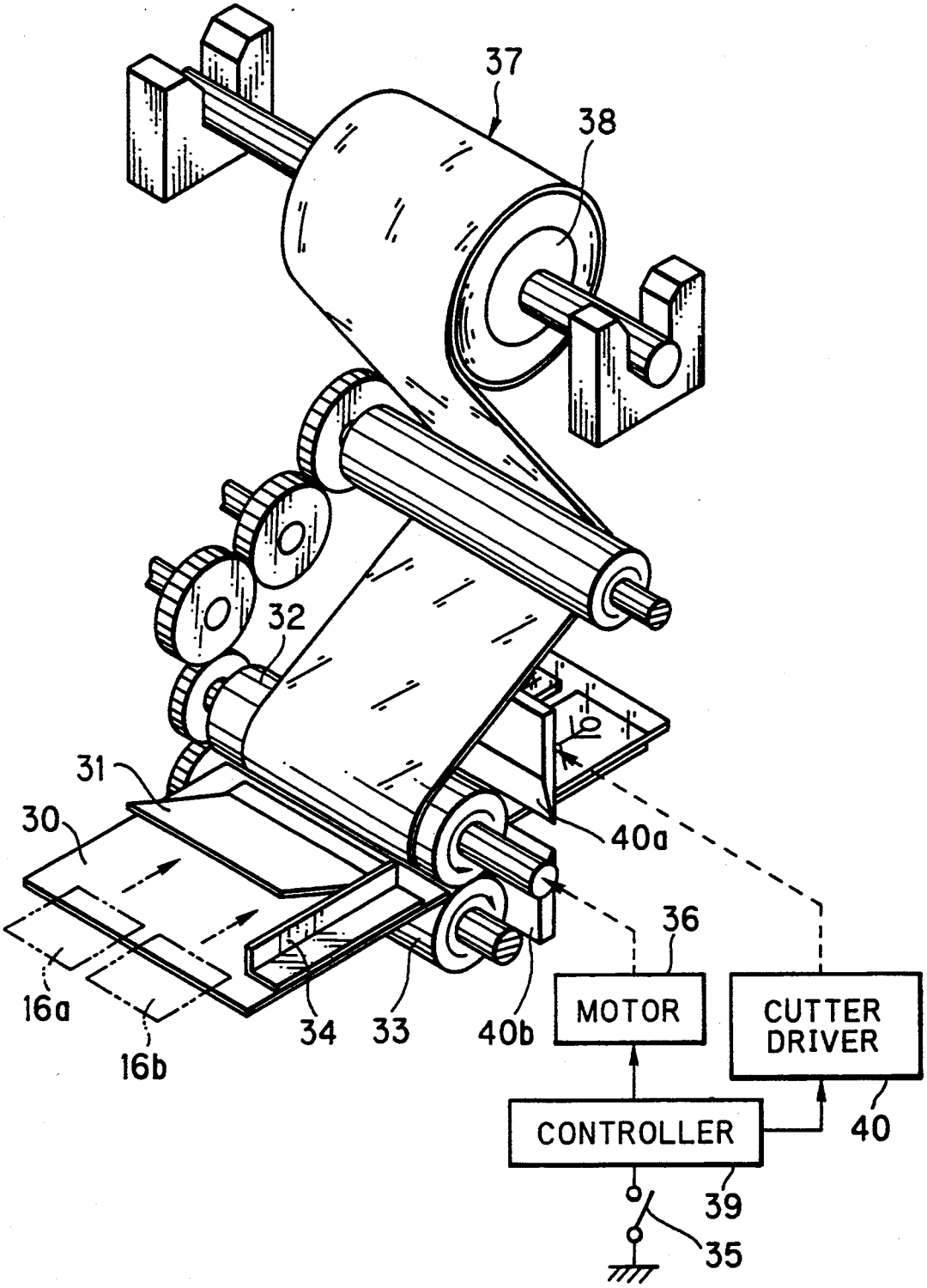
FIG. 7 is a perspective view illustrating a laminator device for laminating the double-sided photograph.

Referring to FIG. 7, a laminator device is used to apply the laminate sheet 18 to the photoprints 16*a* and 16*b*. The two photoprints 16*a* and 16*b* are arranged side-by-side on a support 30, with a narrow reserve space therebetween to allow the laminate sheet 18 to be folded. While facing upwards, the printed surface of the photoprints 16*a* and 16*b* inserted toward a station between a heat roller 32 and a pressure roller 33 while being guided by a plate 31. During this insertion, a lateral edge of the photoprint 16*b* is in contact with a lateral plate 34. The photoprints 16*a* and 16*b* are inserted until their advancing edge is nipped between the rollers 32 and 33. The reserved space between the photoprints 16*a* and 16*b* and support 30 is within the general range of 0.5 to 3 mm wide, and preferably 1 to 2 mm.

When a switch 35 is actuated, a motor 36 is driven to rotate the heat roller 32 and the pressure roller 33 so that a transparent continuous sheet 37 is pulled from a supply reel 38. While the continuous sheet 37 is being fed, the photoprints 16*a* and 16*b* are advanced toward and nipped by the rollers 32 and 33. Each photoprint 16*a* and 16*b* is guided by the guide plate 31, which prevents them from slanting or rotating while being fed. After the prints have been nipped and while the rollers 32 and 33 continue to rotate, the pressure roller 33 places the continuous sheet 37 in pressure contact with the printed surface of the photoprints 16*a* and 16*b*. The heat roller 32 applies heat to the continuous sheet 37, thus attaching it to the photoprints 16*a* and 16*b*.

A controller 39 feds the continuous sheet 37 for a length slightly larger than the range of the photoprints 16*a* and 16*b*, stops the motor 36, and then actuates a cutter driver 40. The continuous sheet 37 is cut between a movable blade 40*a* and a stationary blade 40*b* to obtain the laminate sheet 18.

After lamination, the tape 20 is attached to the rear of the photoprint 16*a*. The laminate sheet 18 is then folded in half (with one photoprint 16*a* and 16*b* on one-half and the other photoprint on the other half) and then because of the tape 20 the photoprints 16*a* and 16*b* are attached to one another. The double-sided photograph 11 is thus obtained in a form of a leaf. A plurality of double-sided photographs are made in this manner and combined in a stack having the fore edges of each photograph aligned.

As described above, the size of the laminate sheet 18 is large enough so as to cover the two photoprints 16*a* and 16*b* and to allow the prints to be folded. However, the photoprints may be rather largely spaced apart in which case a longer laminate sheet would be required. In this case, the folded narrow portion of the laminate sheet as folded may have to be cut along fore edges of the photoprints. This permits easier positioning of the photoprints 16a and 16b relative to the lamination sheet 18.

Next, each back portion 12a of the fly papers 12, is attached with paste to the back of the end papers 13. The fly paper 12 can be used as a title page for the album 10 by adding the appropriate text.

The end papers 13 together with the fly papers 12 are disposed to sandwich the stacked double-sided photographs 11, with the adhesive tape 25 therebetween. The longitudinal edges of the tape 25 are bent around and against the surface of the stack. The rear of the fly leaf 13a is mounted on the double-sided tape 26, which attaches it to the rear of the cover 15 on the other side. The album 10 as shown in FIG. 2 is thus obtained.

The album 10 as described herein, may contain a number of pages such as 20 pages or preferably 12 pages. The size of a printed frame, which includes the photoprint could be the same for each page of the album, or the size can vary between the separate pages. Thus, because of the many possibilities, the album can be designed with a theme to be aesthetically pleasing.

The layout of the individual pages of the album include the size of a printed frame and the posture or framing manner (i.e., horizontal or vertical orientation) in which the camera is held while taking a photograph. Frame sizes include, for example, Range A—118×165 mm, Range B—148×204 mm, and Range C—89×125 mm. For these ranges, the photographic paper per page is about 204×204 mm.

Figures 8, 9:
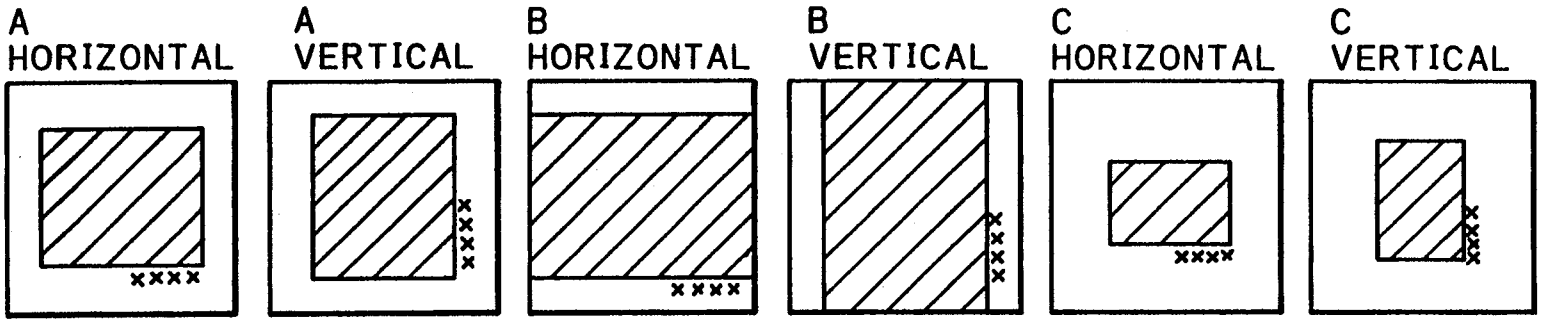
FIG. 8 is an explanatory view illustrating printing layouts of photoprints to be laminated.
FIG. 9 is a table illustrating a relationship between pages of the album and sizes of original frames to be printed.

In general, the layout of an album is carried out by a skilled professional, who is excellent at both arranging and sizing the selected original frames. However, if a non-professional, such as a customer, sizes the original frames, the finished layout of the album would be expected to be average or even inferior in quality. In some instances, the photofinisher will recommend a predetermined layout with set frame sizes for the pages in the album, as illustrated in the table of FIG. 9. The recommended layout or arrangement (i.e., varying the size of the printed frame) has been found to be superior, on the basis of tests in consideration of rhythm, clearness and good impressions for providing an aesthetically pleasing album.

The planar posture includes either an horizontal or vertical orientation. Generally, the photofinisher visually inspects the original frames and orients them in a particular manner. It is, however, preferable for the customer to designate the planar posture so as to avoid any mistake by the photofinisher.

The sizes of the prints may also be selected by the customer.

The square shape of the photographic paper as shown in FIG. 8 is advantageous in that a printing process requires no consideration of the planar posture. Frames of "B/Horizontal" and "B/Vertical" can be similarly printed without regard to the desired posture until the photoprints are to be laminated. The pages may alternate between rectangular and parallelogram.

Figure 10:
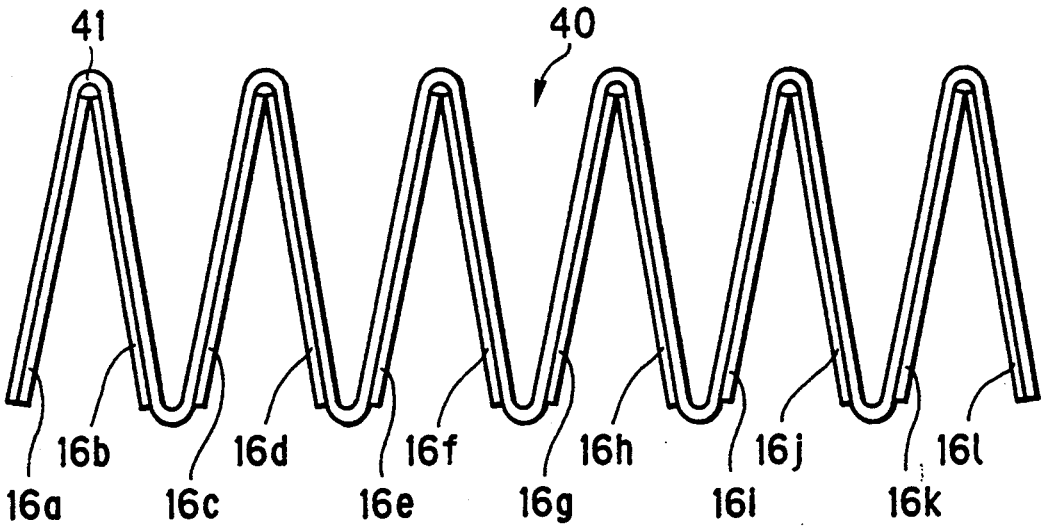
FIGS. 10 and 11 are explanatory views illustrating a second preferred embodiment of a double-sided photograph before and after adhesion, respectively.
Figure 11:
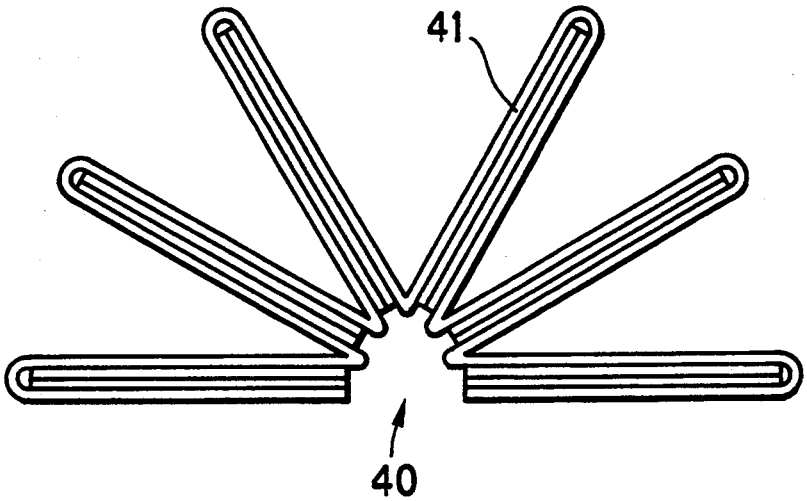

The double-sided photograph 11 having the two photoprints 16a and 16b can be used without being bound. Further a double-sided photograph may include a greater number of photoprints (e.g., 12), 16a, 16b, 16c, . . . , 16l, as illustrated in FIGS. 10 and 11. A laminate sheet 41 of a predetermined length is placed on the photoprints 16a to 16l successively arranged, and is folded in a zigzag. Six pairs of the adjacent photoprints 16a to 16l are attached together rear-to-rear with an adhesive, such as tape. This arrangement is advantageous in that the laminator device can laminate at one time a great number of photoprints, thus efficiently making a double-sided photograph.

The laminate sheet may be partially transparent, for instance, at the middle of a particular shape (e.g., a loop or a heart), and/or partially colored or opaque in a predetermined area. The laminate sheet may also be provided with a patterned design.

Figure 12:
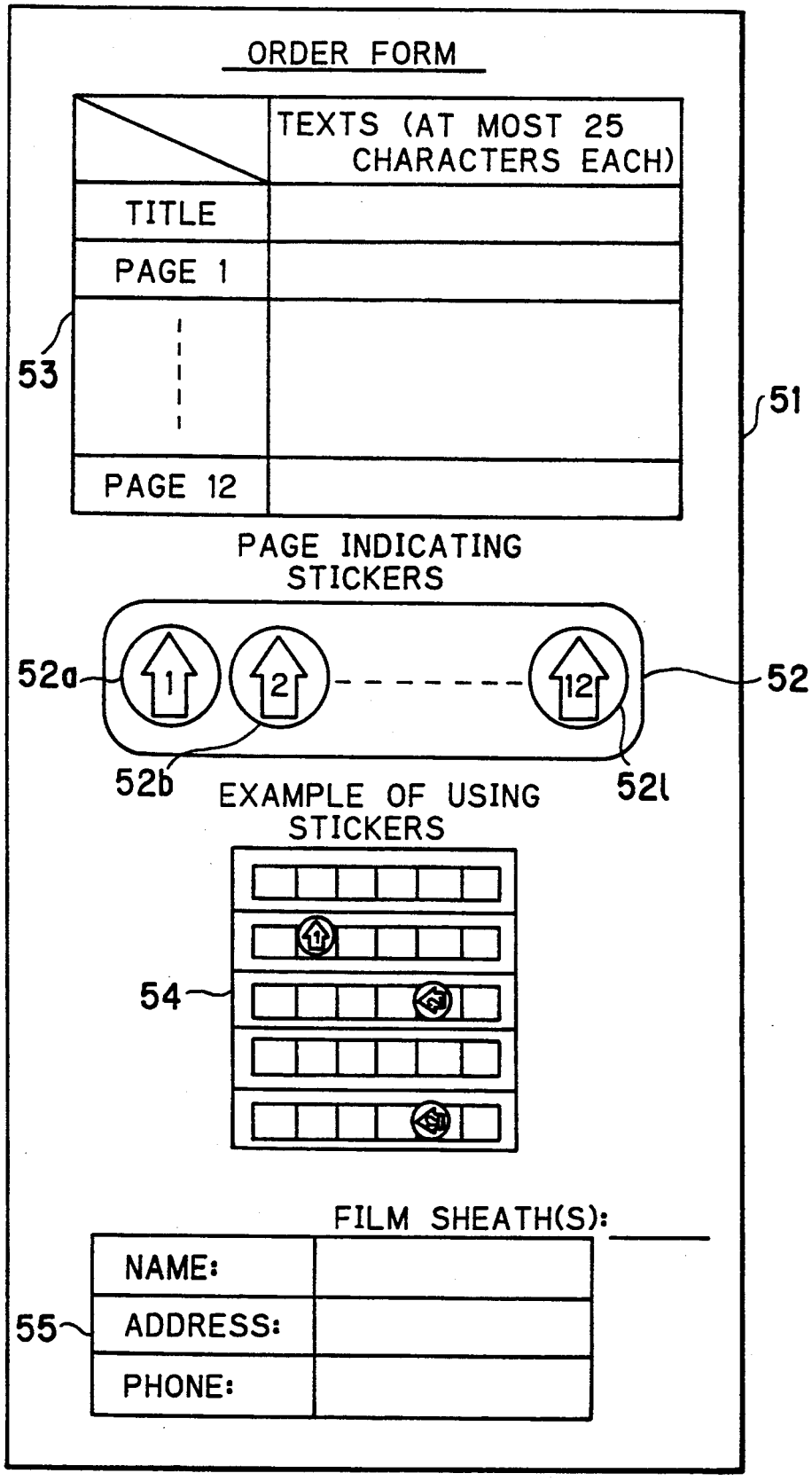
FIG. 12 is a plan view illustrating an order form for ordering the album.

A customer order form 51 used to order an album with a desired layout from a photofinisher according to the present invention is illustrated in FIG. 12. The order form 51 consists of a sheet of paper and a sticker portion 52. The order form 51 includes blanks 53 for filling in text, a template 54 illustrating a manner of applying the stickers, and blanks 55 for providing customer identification, such as name, address, and telephone number.

As shown in FIG. 13, the sticker portion 52 is constituted of a sheet 57 with an adhesive layer 58 coated on the rear thereof, and is supported on a support sheet 56 via a peelable layer 59. The support sheet 56 is attached to the form sheet 51.

The sticker portion 52 is provided with 12 circular cuttings 60, which define page-indicating stickers 52a to 52l therein. On the stickers 52a to 52l, there are printed numbers from "1" to "12", designating page numbers and arrows indicating a direction such as the top of the pages in the album. The stickers 52a to 52l are selected by the customer and stuck to a film sheath in positions corresponding to selected original frames of a film strip. Since the film sheaths are transparent or semi-transparent, the selected original frames are visually recognizable.

It is desirable for the order form to provide a prearranged, recommended arrangement or layout of a pages and a size of the original frames, similar to that shown in the table of FIG. 9. The page-indicating stickers may have a marking different from the arrows which indicate a top or bottom of the pages as illustrated in any of FIGS. 14A to 14C. The stickers 52a to 52l may be stuck directly on selected original frames of the film strips.

A process of ordering the album will now be described.

Figure 15:
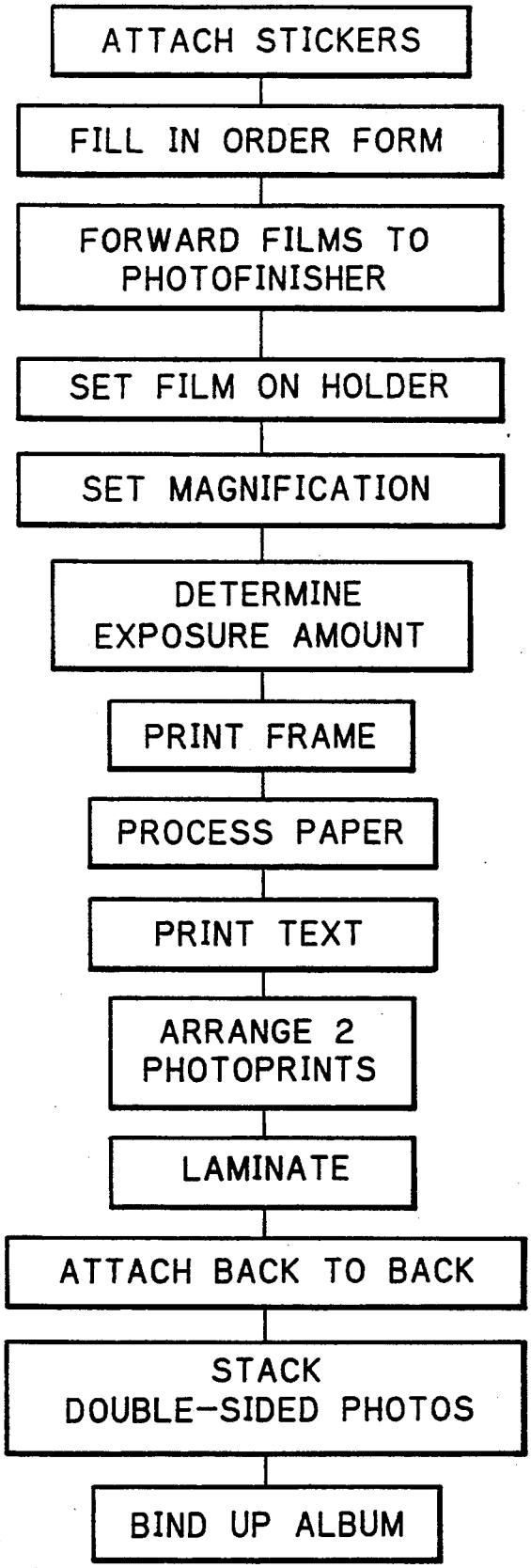
FIG. 15 is a flow chart illustrating a process of making the booklet album.
Figure 17:
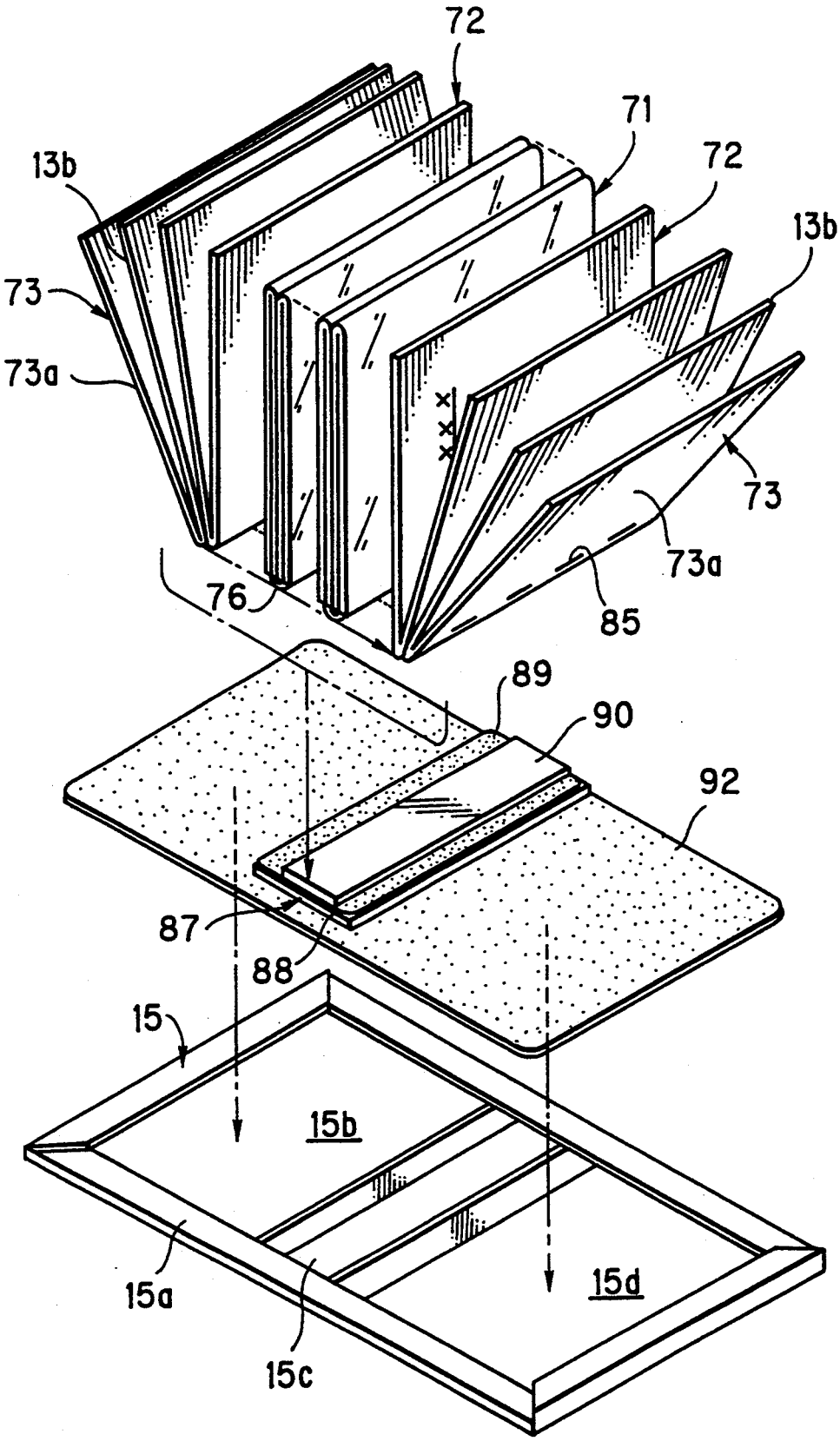
FIG. 17 is an exploded perspective view illustrating a third preferred embodiment of a booklet album.
Figure 18:
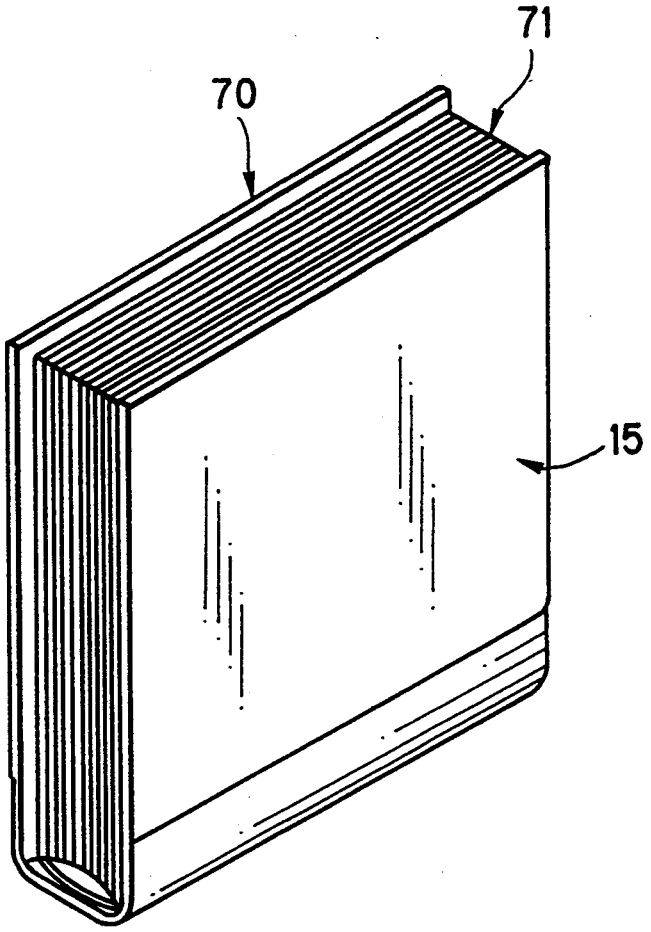
FIG. 18 is a perspective view illustrating the booklet album of FIG. 17.

Referring to FIG. 15, the customer selects original frames from developed strips of film as contained in film sheaths. The stickers 52a to 52l are peeled from the sheet of the order form 51 as provided from the photofinisher, and are stuck on the film sheath in areas which designate the desired original frame. The number on each of the stickers is considered so as to determine the page of each selected original frame, and to compile the selected original frames in the order as desired by the customer.

After placing the stickers 52a to 52l in place, text may be filled in the blanks 53 on the order form 51 as desired by the customer to provide location, date, comments, etc. The text is preferably at most 25 characters and appear as the title on the leftward-openable fly leaf and on the pages in the margin, as illustrated by the X's in FIG. 8. After the blanks 55 are filled in, the order form 51 and the film with the stickers 52a to 52l stuck are forwarded to the photofinisher, who will then construct an album accordingly.

The photofinisher carefully enlarges the prints for each selected photoprint using an enlarger. The film piece including the original frame as designated with the sticker 52a, which corresponds to page 1, is obtained and positioned in the posture following the arrow on the sticker 52a, so as to set the film piece on a film holder. Because the original frame for the first page is predetermined to have a size in the Range A, as shown in FIG. 9, the printing magnification is set accordingly to reproduce and enlarge the photo to 118×165 mm.

After setting the printing magnification, photometry is performed by an analyzer incorporated in the enlarger, to obtain an appropriate exposure amount, according to which a trial photoprint is made on a piece of photographic paper. The paper piece is developed and inspected. Any necessary corrections are made and entered into the analyzer. An aperture of a paper mask is then adjusted according to Range A. Once the paper mask is set, the paper is printed. The paper as exposed is set to a processor, developed, dried and cut, to obtain the final photoprint.

The remaining selected original frames, which are selected with stickers 52b to 52l, are printed according to the above steps. The photofinisher inputs and prints the texts onto the photoprints in the predetermined positions in accordance with the instructed texts in the blanks 53, e.g., by means of a word processor. Afterwards, the photoprints 16a and 16b are arranged in the instructed order and in the designated posture. As described above, the photoprints are then arranged so that the laminate sheet can be folded. The photoprints are then subjected to a step of lamination as described above with reference to FIGS. 3 to 7. Double-sided,-photos as obtained are bound together to complete an album like that shown in FIGS. 1 and 2.

Although the stickers 52a to 52l have numbers and arrows designating both pages and the head of a page, the arrows may be omitted, because the horizontal or vertical orientation of the image in the original frames can be discerned by inspecting the negative image itself.

Further, novel stickers 62a to 62l may designate a size of an original frame in addition to having the numbers and arrows, as illustrated in FIG. 16. Ranges A to C are represented by colors of green, yellow and blue, as indicated by different hatching. An order form having these stickers is oriented so that for the customer accepting the recommended prearranged relationship of the frame sizes with the page numbers of FIG. 9 is as follows: the stickers 62a, 62b and 62d for pages 1, 2 and 4 are printed in green for designating Range A; the sticker 62c for page 3 is printed in yellow for designating Range B; and the sticker 62l for page 12 is printed in blue for designating Range C.

There may be also provided a set of stickers having indications printed as A1, A2, B3, A4, A5, B6, B7, A8, A9, A10, B11 and C12, instead of 1 to 12.

A second preferred embodiment directed to a booklet album will now be described.

The booklet album according to the first embodiment, as described above, may be disadvantageous in that a plurality of double-sided photographs 11 are bound using only binding tape 25. When using binding tape, it is necessarily provided with enough adhesive layer for binding the double-sided photographs together, and, consequently, adhesive agent from the tape may overflow into gutters between the pages. As a result, the printed surfaces of the double-sided photographs may become dirty, and in some cases it may become difficult to separate pages.

FIGS. 17 to 22 illustrate a novel album 70 according to the second embodiment which solves such problems. Elements and components similar to those of the former embodiment are designated with the same reference numerals.

The album 70 includes a plurality of sections 71 or folded material constituting a pair of leaves. Each section 71 consists of two double-sided photographs 11a and 11b and a thin connecting fabric or hinge 76 for interconnecting the double-sided photographs 11a and 11b.

The fabric 76 is as long as the back of the double-sided photographs 11a and 11b, and inserted between the photographs 16a and 16b before they are attached together. When folded, the fabric 76 bounds the respective backs of each page in a uniform manner, and makes it possible to bind the pages while utilizing only small amounts of an adhesive agent. The fabric 76 is white and matches the appearance of the gutters between the pages. The fabric may be replaced with a sheet of calico, paper, or the like.

Figure 21:
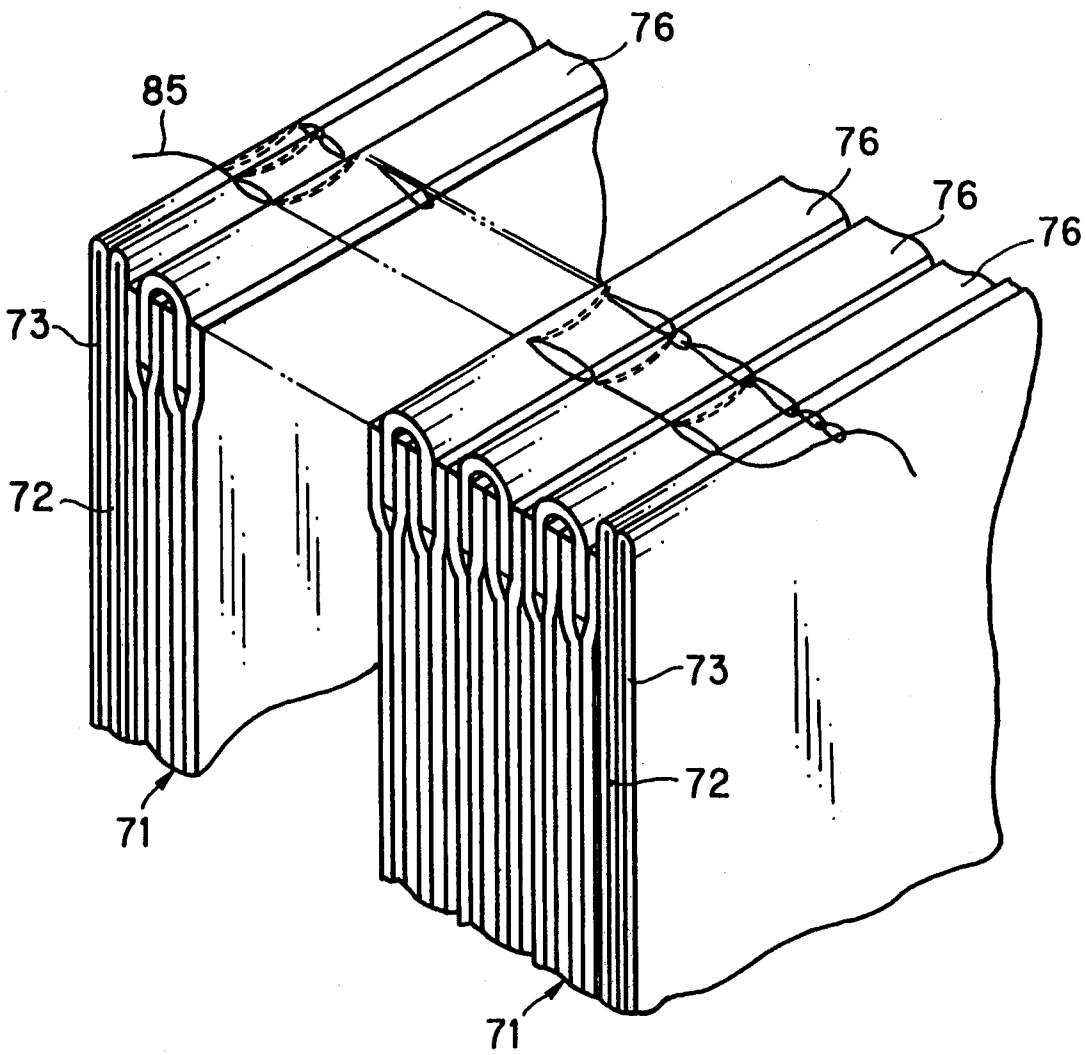
FIG. 21 is a perspective view illustrating the manner in which the back of pairs of double-sided photographs are sewed together.

End papers 73 are folded to have an end leaf 73a and a fly leaf 13b. Fly papers 72 are folded in half and stacked together with the end papers 73 to sandwich the sections 71. The back of the stack is sewn together with thread 85 as illustrated in FIG. 21.

After being sewn, the stack is provided with a backlining 87 for reinforcement. The backlining 87 includes calico 88, paste 89 applied to one whole surface thereof, and thin paper 90 which is as large as the back of the stack and attached to the calico 88 via the paste 89. The calico 88 is as long as the back of the stack and wide enough to be twice-folded so as to sandwich the back of the stack. To the rear of the cover 15 is attached double-sided adhesive tape 92, via which the respective end leaves 73a are attached to the cover 15.

Figure 19:
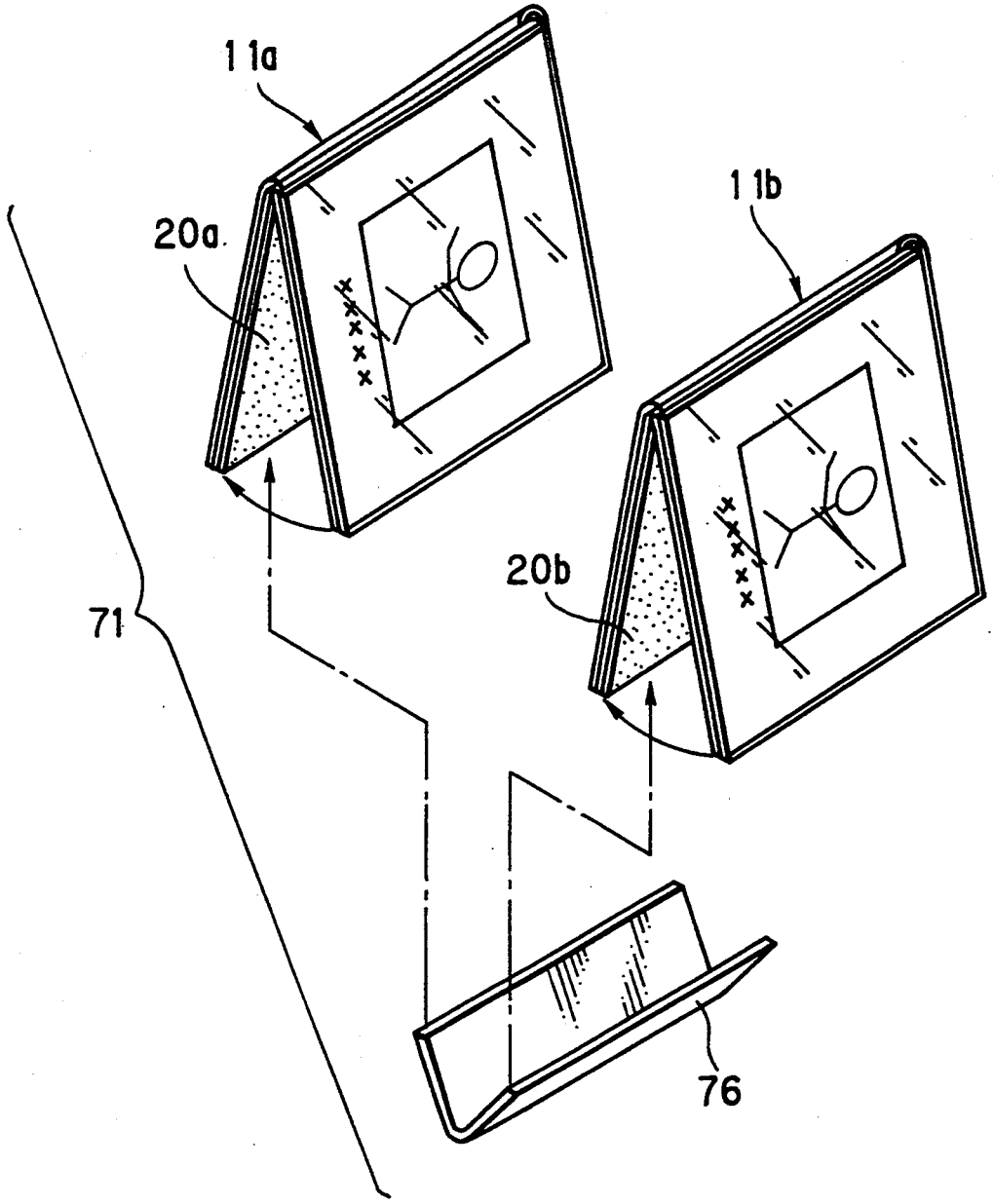
FIG. 19 is an exploded perspective view illustrating a pair of double-sided photographs with connective fabric used in the booklet album.
Figure 20:
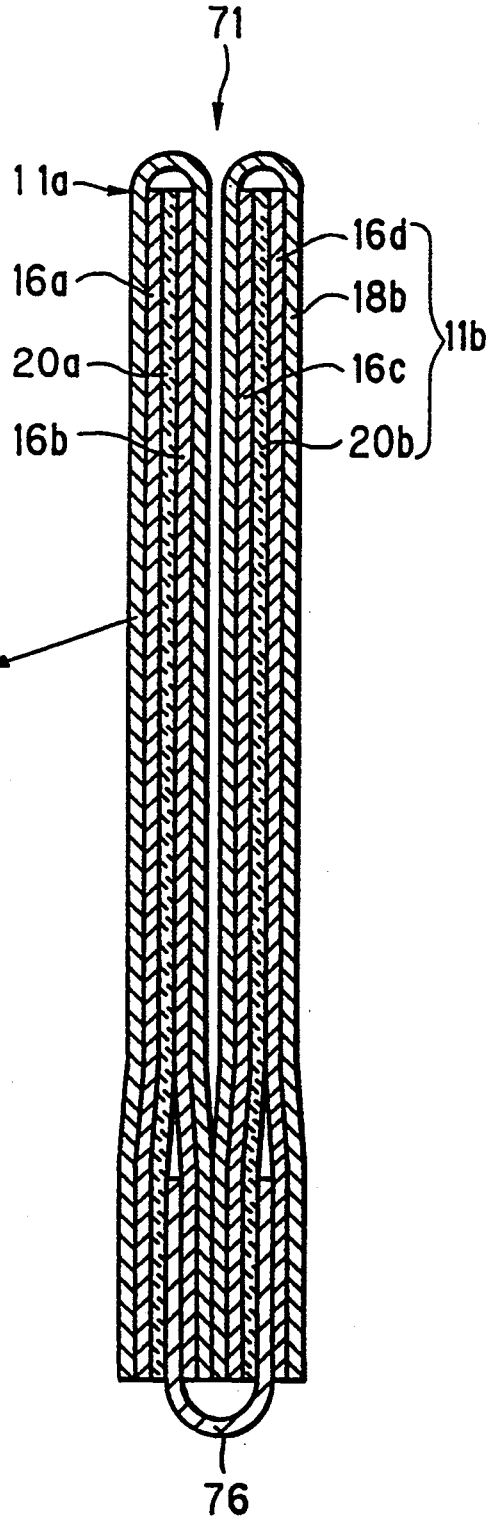
FIG. 20 is a cross-sectional view the double-sided photographs when connected to one another.
Figure 20A:
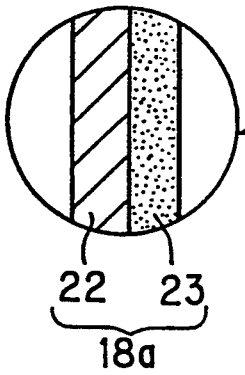
FIG. 20A is an expanded portion of FIG. 20.

Referring to the process of making the novel album 70, the laminate sheet 11a is applied onto the adjacently arranged photoprints 16a and 16b, in the same manner as the former embodiment. As illustrated in FIGS. 19 and 20, the rear of the photoprint 16a is attached to a tape 20a, to obtain an unfinished single double-sided photograph 11a. Once the unfinished double-sided photographs 11a and 11b are prepared, the connective fabric 76 is overlapped partly on the rear surfaces of both unfinished double-sided photographs 11a and 11b. The laminate sheets 18a and 18b are then respectively folded in two between each pair of the photoprints 16a and 16b, 16c and 16d. While the two tapes 20a and 20b are attached to the connective fabric 76, the photoprint 16a is attached to the photoprint 16b, and 16c to 16d. Accordingly, the double-sided photographs 11a and 11b are connected via the fabric 76 to obtain a section 71. Thus, no excess paste results. The gutters of the album remain in good shape and look fine in white.

A plurality of sections 71 are prepared in the above manner. For an album of 12 pages, three sections are made. The sections are stacked and sandwiched between the fly papers 72 and between the end papers 73. The back of the stack is sewn with the thread 85 by use of a sewing device. Pieces of the connective fabric 76 are sewn together with the back of the fly papers 72 and the end papers 73.

Figure 22:
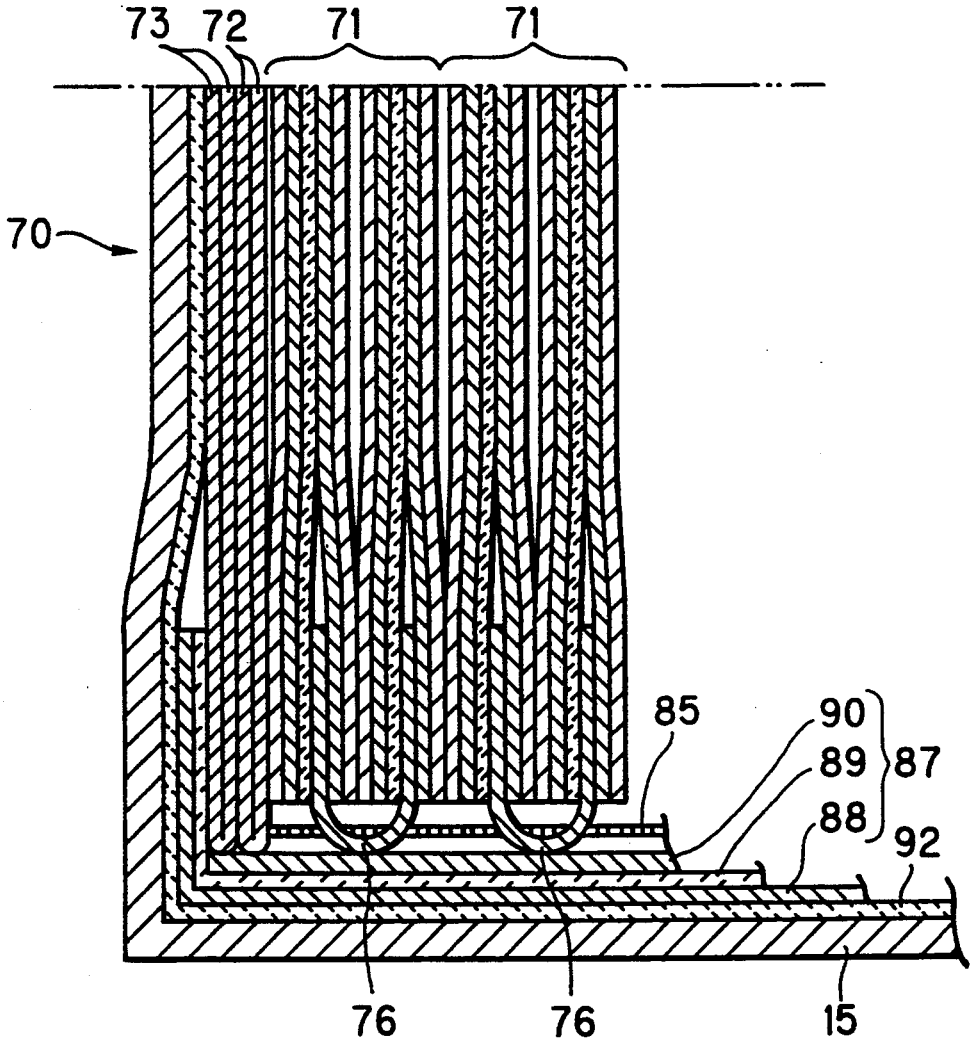
FIG. 22 is a cross-sectional view illustrating a portion of the booklet album when bound.

The backlining 87 is then attached to the back of the stack after it is sewn. Both longitudinal edges of the backlining 87 are bent to sandwich the back of the stack to adhere to it, thereby reinforcing the back of the stack. The rear of the cover 15 is provided with tape 92, to which the end papers 73 are attached, to bind the album 70 as illustrated in FIG. 22. For convenience of illustration, the cardboards 15*b* to 15*d* are not shown with the cover 15 in FIG. 22.

The album 70 which is sewn together can contain at most 32 pages with 16 double-sided photographs or 8 sections, but preferably 16 pages with 8 double-sided photos or 4 sections.

Figure 23:
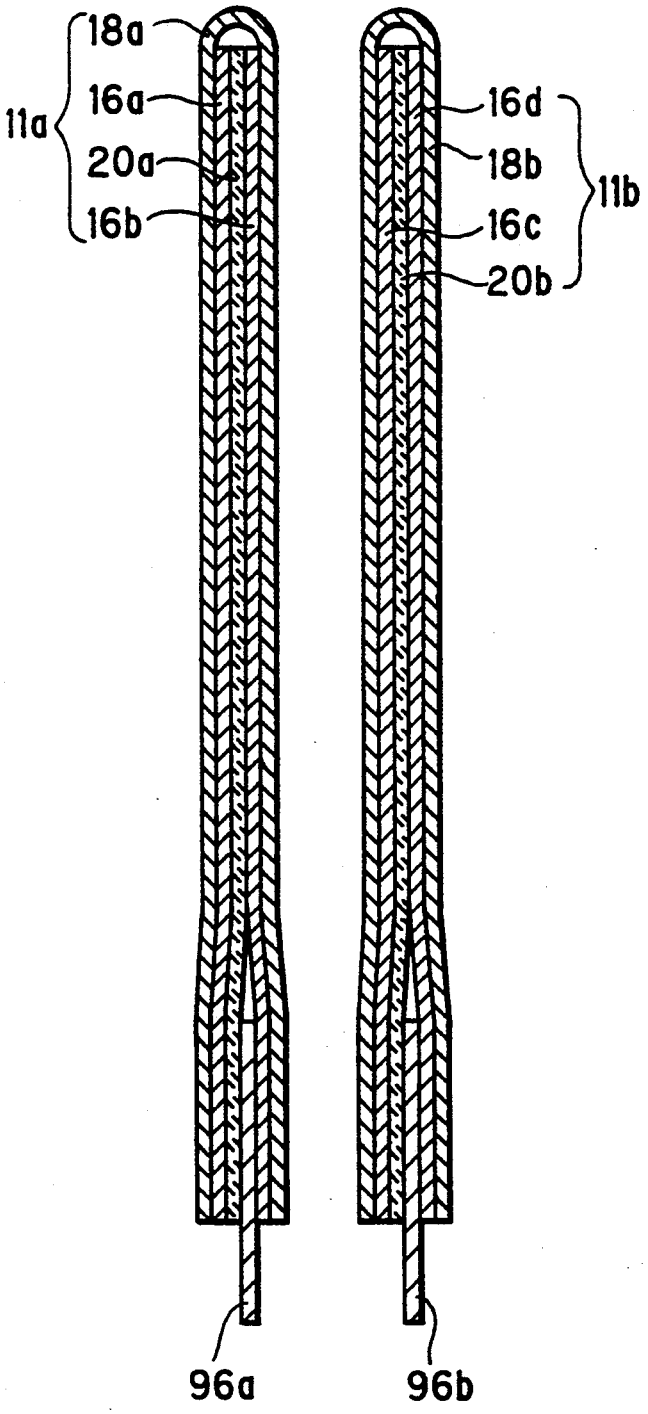
FIG. 23 is a cross-sectional view illustrating another preferred embodiment of connecting the double-sided photographs using a connective fabric.

According to the above embodiment, the double-sided photographs 11*a* and 11*b* are interconnected with the connective fabric 76, however, a piece of connective fabric may be adapted for binding for each of the double-sided photographs. In FIG. 23, separate pieces 96*a*, 96*b* of thin fabric are attached respectively to the double-sided photos 11*a* and 11*b*. A plurality of such double-sided photographs are stacked, bound together with thread sewn, and covered by the cover 15 of FIG. 17.

Although the present invention has been fully described by way of preferred embodiments with reference to the accompanying drawings, various changes and modifications will be apparent to one of ordinary skill in the art. Therefore, unless such changes and modifications depart from the spirit and scope of the present invention, they should be construed as included therein.

What is claimed is:

1. A method of making a booklet album having a plurality of photoprints bound to one another, comprising the steps of:

a first determining step for correlating pages in the album with particular ones of selected original frames of a photographic film;

a second determining step for determining posture of said photoprints to be reproduced from said original frame borne on said pages;

printing each of said selected original frames in accordance with a corresponding posture in order to obtain said photoprints after said first and second determining steps;

correlating said photoprints with said pages in an order corresponding to said first and second determining steps after said printing step; and binding said pages with said photoprints to form said album.

2. A booklet album making method as defined in claim 1, wherein said photoprints are on photographic paper.

3. A booklet album method as defined in claim 2, wherein said second determining step comprises determining an orientation of said printed frames relative to said pages.

4. A booklet album method as defined in claim 3, wherein said second determining step comprises determining vertical and horizontal orientations relative to said pages.

5. A booklet album making method as defined in claim 2, wherein said second determining step comprises designating the sizes of said printed frames.

6. A booklet album making method as defined in claim 5, wherein, during said second determining step, said sizes of said photoprints are predetermined in further correspondence with said pages, and said photoprints are designated as having one of vertical extension orientation and horizontal extension orientation within said pages.

7. A booklet album making method as defined in claim 5, wherein said photoprints are square.

8. A booklet album making method as defined in claim 6, wherein said photoprints are grouped into pairs, each of the pairs including photoprints attached to rear surfaces of each other and being laminated with a single transparent sheet.

9. A booklet album making method as defined in claim 8, wherein a phrase is printed beside said printed frames.

10. A double-sided photograph comprising:

a plurality of photoprints; and a single transparent sheet laminated on printed surfaces of said photoprints, said transparent sheet being folded at a portion thereof which is between adjacent ones of said photoprints to place back surfaces of said photoprints, which are opposite to said printed surfaces, in opposition to one another.

11. A double-sided photograph as defined in claim 10, wherein said photoprints are grouped into at least one pair, each rear surface of every two associated photoprints are attached to one another.

12. A double-sided photograph as defined in claim 11, wherein said two photoprints are attached by double-sided adhesive tape.

13. A double-sided photograph as defined in claim 11, wherein said photoprints are an even number of photoprints of at least four, and said transparent sheet is folded in a zigzag manner.

14. A double-sided photograph as defined in claim 11, wherein said plurality of photoprints is two photoprints.

15. A booklet album comprising:

a plurality of double-sided photographs stacked adjacent to one another, each of said double-sided photographs comprising at least two photoprints arranged side-by-side, said photoprints having a printed surface thereof laminated with a transparent sheet, and a first adhesive applied to rear surfaces thereof, said transparent sheet being folded in half so that the rear surfaces are disposed in opposition to one another and attached together through the first adhesive; and a cover for covering an outside of said stacked double-sided photographs.

16. A booklet album as defined in claim 15, further comprising a pair of end papers for sandwiching said stacked double-sided photographs, a rear of said cover being attached to said end papers.

17. A booklet album as defined in claim 16, wherein a back of each of said double-sided photographs is attached to said cover.

18. A booklet album as defined in claim 17, wherein said first adhesive is double-sided adhesive tape.

19. A booklet album as defined in claim 16, further comprising a connective sheet attached to said double-sided photographs by being inserted partially between said rear surfaces of said photoprints when the photoprints are folded in half.

20. A booklet album as defined in claim 19, wherein said connective sheet is associated in a one-to-one relationship with said double-sided photograph.

21. A booklet album as defined in claim 19, wherein said connective sheet is respectively attached to two double-sided photographs so as to connect said two double-sided photographs together.

22. A booklet album as defined in claim 19, further comprising thread for sewing a plurality of connective sheets in order to bind said double-sided photographs.

23. A booklet album as defined in claim 22, further comprising a backlining structure mounted on a back of a stack of said bound double-sided photographs, said structure including:

a backlining member attached to said cover so as to cover said back of said stack;

a second adhesive applied to a surface of said backlining member facing said stack for attaching said backlining member to said end papers; and thin paper disposed between said back of said stack and said backlining member.

24. A booklet album as defined in claim 23, wherein said backlining member is calico, and said second adhesive is paste.

* * * * *